US006733249B2

(12) United States Patent
Maier et al.

(10) Patent No.: US 6,733,249 B2
(45) Date of Patent: May 11, 2004

(54) MULTI-STAGE INTERNAL GEAR FUEL PUMP

(75) Inventors: Eugen Maier, Clarkston, MI (US); Michael Raymond Raney, Mendon, NY (US)

(73) Assignee: Delphi Technologies, Inc., Troy, MI (US)

( * ) Notice: Subject to any disclaimer, the term of this patent is extended or adjusted under 35 U.S.C. 154(b) by 38 days.

(21) Appl. No.: 10/145,321

(22) Filed: May 14, 2002

(65) Prior Publication Data

US 2003/0012664 A1 Jan. 16, 2003

Related U.S. Application Data

(60) Provisional application No. 60/291,283, filed on May 17, 2001.

(51) Int. Cl.[7] ..... F04B 49/00
(52) U.S. Cl. ..... 417/310; 417/410.4; 418/9
(58) Field of Search ..... 417/310, 410.4, 417/410.3; 418/9, 171

(56) References Cited

U.S. PATENT DOCUMENTS

| | | | | |
|---|---|---|---|---|
| 4,199,305 A | | 4/1980 | Pareja | 417/440 |
| 5,139,395 A | * | 8/1992 | Kemmner | 417/366 |
| 5,393,203 A | | 2/1995 | Hantle | 417/203 |
| 5,544,540 A | | 8/1996 | Holman | 74/467 |
| 5,554,019 A | | 9/1996 | Hodge | 418/171 |
| 5,593,287 A | | 1/1997 | Sadakata et al. | 417/366 |
| 5,711,408 A | | 1/1998 | Dick | 192/85 R |
| 5,722,815 A | | 3/1998 | Cozens | 417/310 |
| 5,733,111 A | | 3/1998 | Yu et al. | 418/78 |
| 5,762,484 A | | 6/1998 | Whitham | 418/171 |
| 5,797,734 A | * | 8/1998 | Kizer et al. | 418/9 |
| 5,997,262 A | | 12/1999 | Finkbeiner et al. | 417/410.4 |
| 6,017,202 A | | 1/2000 | Durnack et al. | 418/171 |

(List continued on next page.)

FOREIGN PATENT DOCUMENTS

| | | |
|---|---|---|
| DE | 36 13 734 | * 10/1987 |
| EP | 0 657 640 A1 | 6/1995 |

OTHER PUBLICATIONS

See U.S. Ser. No. 10/126,190, filed Apr. 19, 2002, for: Multi–Stage Internal Gear/Turbine Fuel Pump, inventor: Eugen Maier.

*Primary Examiner*—Justine R. Yu
*Assistant Examiner*—Michael K. Gray
(74) *Attorney, Agent, or Firm*—Jimmy L. Funke

(57) ABSTRACT

A multi-stage internal gear fuel pump for a vehicle includes a housing having an inlet and an outlet and a motor disposed in the housing. The multi-stage internal gear fuel pump also includes a shaft extending axially and disposed in the housing for rotation by the motor. The multi-stage internal gear fuel pump further includes a plurality of pumping modules disposed axially along the shaft and each having an internal gear and an external gear cooperating with each other for rotation by the motor to pump fuel from the inlet to the outlet.

30 Claims, 7 Drawing Sheets

U.S. PATENT DOCUMENTS

| | | | | |
|---|---|---|---|---|
| 6,106,240 | A | 8/2000 | Fischer et al. | 417/203 |
| 6,113,360 | A | 9/2000 | Yu et al. | 417/310 |
| 6,149,410 | A | 11/2000 | Cooper | 418/32 |
| 6,186,118 | B1 | 2/2001 | Spakowski | 123/452 |
| 6,230,691 | B1 | 5/2001 | Coha et al. | 123/514 |
| RE37,632 | E | 4/2002 | Bouchauveau et al. | 123/458 |
| 6,363,917 | B1 | 4/2002 | Hopley | 123/502 |
| 6,379,132 | B1 | 4/2002 | Williams | 417/470 |
| 6,394,762 | B1 | 5/2002 | Collingborn et al. | 123/516 |
| 6,402,460 | B1 | 6/2002 | Fischer et al. | 415/55.1 |
| 6,405,717 | B1 | 6/2002 | Beyer et al. | 123/514 |
| 6,406,269 | B1 | 6/2002 | Dingle et al. | 417/218 |
| 6,408,830 | B1 | 6/2002 | McGrath | 123/509 |
| 6,435,810 | B1 | 8/2002 | Fischer et al. | 415/55.1 |
| 6,447,263 | B1 | 9/2002 | Cooke et al. | 417/297 |
| 6,454,521 | B1 | 9/2002 | Anderson et al. | 415/55.1 |
| 6,464,450 | B1 | 10/2002 | Fischer | 415/55.1 |
| 6,499,941 | B1 | 12/2002 | Fischer | 415/55.4 |
| 6,505,644 | B2 | 1/2003 | Coha et al. | 137/565.22 |
| 6,517,327 | B2 | 2/2003 | Beyer et al. | 417/363 |
| 6,527,506 | B2 | 3/2003 | Pickelman et al. | 415/55.1 |
| 6,533,538 | B2 | 3/2003 | Aslam et al. | 415/55.2 |
| 6,546,916 | B2 | 4/2003 | Hopley | 123/502 |
| 6,623,237 | B2 | 9/2003 | Harris et al. | 415/55.1 |
| 6,626,148 | B1 | 9/2003 | Cooke et al. | 123/447 |

* cited by examiner

MULTI-STAGE INTERNAL GEAR FUEL PUMP

CROSS-REFERENCE TO RELATED APPLICATION(S)

The present invention claims the priority date of copending U.S. Provisional Patent Application Serial No. 60/291,283, filed May 17, 2001.

TECHNICAL FIELD

The present invention relates generally to fuel pumps for vehicles and, more particularly, to multi-stage internal gear fuel pump for a vehicle.

BACKGROUND OF THE INVENTION

It is known to provide a fuel tank in a vehicle to hold fuel to be used by an engine of the vehicle. It is also known to provide a fuel pump to pump fuel from the fuel tank to the engine. Examples of such fuel pumps are mechanically or electrically driven piston pumps, turbine pumps, gear pumps and mechanically, electrically or hydraulically driven diaphragm pumps. Some of the pumps used in systems for direct injection of volatile fluids such as gasoline are cam driven or crankshaft/connecting rod mechanism pumps. These pumps require a driving shaft and dynamic seals to prevent fuel leakage outside a pump housing or fuel to penetrate into a lubricated driving mechanism area. These pumps also require a shaft coupling a pump driving shaft with a source of rotational movement (e.g., engine crankshaft, camshaft). Some of these driving sources impose a specific location for the pump in the engine compartment. Dynamic sealing systems are usually expensive and do not guarantee an extensive leak free working life that meets fuel emission requirements for modern engines.

Engine driven pumps for direct injection systems also require an additional lift or prime pump to supply fuel from the fuel tank to the engine driven pump thereby increasing system cost. Pumps that are engine driven also have difficulty achieving pressure during vehicle starting conditions since rotational speed is typically below ideal pump speed thus resulting in starts under less than ideal conditions. This could lead to degraded start performance and higher emissions. Further, piston type engine driven pumps typically utilize drain and re-circulation lines to contain leak and dissipate heat, respectively, adding to cost and complexity.

For high pressure applications, such as gasoline direct injection operating at 5 MPa, attempts to use electrically driven single-stage internal gear pumps usually results in low efficiency-high power requirements. High leakage between gear teeth and gear faces reduces efficiency at high operating pressure necessitating the need for very tight tolerances. Tight tolerances usually result in high cost and poor durability.

Therefore, it is desirable to provide a pump that can be used for pumping volatile or non-volatile fluids for a vehicle. It is also desirable to provide a fuel pump for a vehicle that has an electrical driving mechanism contained within a common housing, eliminating the need for additional prime or lift pumps. It is further desirable to provide a fuel pump that eliminates any source of fluid leak for a vehicle and is able to provide adequate flow at desired pressure during vehicle starting conditions. Additionally, it is desirable to provide a pump that can be mounted either in a fuel line or fuel tank. It is still further desirable to provide a pump not requiring drain or re-circulating lines. It is also desirable to provide a pump that can be modular in design so that pumping sections can be added to reduce sectional pressure differential and provide for operation at higher pressure and efficiency at nominal tolerance levels.

SUMMARY OF THE INVENTION

It is, therefore, one object of the present invention to provide a multi-stage internal gear fuel pump for a fuel tank or for "in-line" mounting in a vehicle.

It is another object of the present invention to provide a multi-stage internal gear fuel pump for a vehicle that provides a driving mechanism completely contained within a pump housing.

It is yet another object of the present invention to provide a multi-stage internal gear fuel pump for a vehicle that provides high discharge fuel pressure to satisfy requirements of a gasoline direct injection fuel system.

To achieve the foregoing objects, the present invention is a multi-stage internal gear fuel pump for a vehicle including a housing having an inlet and an outlet and a motor disposed in the housing. The multi-stage internal gear fuel pump also includes a shaft extending axially and disposed in the housing for rotation by the motor. The multi-stage internal gear fuel pump further includes a plurality of pumping modules disposed axially along the shaft and each having an internal gear and an external gear cooperating with each other for rotation by the motor to pump fuel from the inlet to the outlet.

One advantage of the present invention is that a multi-stage internal gear fuel pump is provided for a vehicle. Another advantage of the present invention is that the multi-stage internal gear fuel pump is low cost, simple construction and eliminates the need for expensive dynamic shaft seals. Yet another advantage of the present invention is that the multi-stage internal gear fuel pump eliminates the need for mechanical coupling with a driving device. Still another advantage of the present invention is that the multi-stage internal gear fuel pump can be placed in the fuel line near the fuel tank or located in the fuel tank. A further advantage of the present invention is that the multi-stage internal gear fuel pump incorporates a high speed DC electrical motor, allowing a quick priming of the pump and fast pressure/flow generating and eliminating the need for lift or prime pumps. Yet a further advantage of the present invention is that the multi-stage internal gear fuel pump is compact, modular and easy to assembly. Still a further advantage of the present invention it that the multi-stage internal gear fuel pump incorporates a plurality of modular pumping sections, allowing output pressure to be increased to a required value of direct injection fuel systems. Another advantage of the present invention is that the multi-stage internal gear fuel pump incorporates integral pressure regulation or pressure by feedback-speed control which simplifies the system to a single line supply typically called return-less or demand supply.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
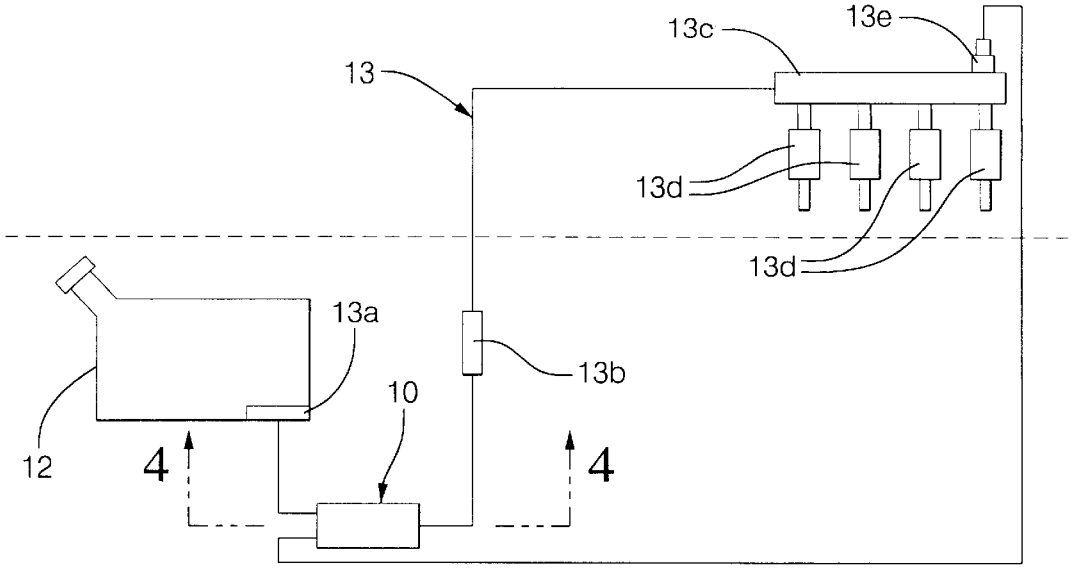
FIG. 1 is a diagrammatic view of the multistage internal gear fuel pump, according to the present invention, illustrated in operational relationship in-line with a fuel tank in a direct injection fuel system.

Referring to the drawings and in particular FIGS. 1 through 4, one embodiment of a multi-stage internal gear fuel pump 10, according to the present invention, is shown for fuel tank 12 of a vehicle (not shown). It should be appreciated that frequent use of the word "pressure" in the subsequent description of the invention may not imply delivery thereof.

As illustrated in FIG. 1, the multi-stage internal gear fuel pump 10 is used in a direct injection fuel system, generally indicated at 13, with closed loop electronic speed/pressure control. In the fuel system 13, the multi-stage internal gear pump 10 is a medium-pressure pump that can be located in the vehicle such as "in-line" close to the fuel tank 12 and connected to a fuel strainer 13*a* therein and a fuel filter 13*b* mounted outside the fuel tank 12. The fuel system 13 includes a fuel rail 13*c* connected by a high-pressure supply line to the fuel filter 13*b* and a plurality of fuel injectors 13*d* connected to the fuel rail 13*c*. As illustrated, the multi-stage internal gear fuel pump 10 may have closed-loop electronic pressure control via a pressure transducer 13*e* mounted to the fuel rail 13*c* or integral with the fuel pump 10 and controlled by an electronic controller (not shown) for pump speed-pressure feedback control. The multi-stage internal gear fuel pump 10 may be used in a supply and delivery system (not shown) for direct injection or for methanol/water delivery to a fuel cell reformer (not shown). The multi-stage internal gear fuel pump 10 may also be used for pumping volatile or non-volatile fluids (fuel or water) at a medium (3 Mpa.) or higher discharge pressure injected into cylinders (not shown) of a spark-ignition internal combustion engine (not shown) or fuel cell reformer. It should be appreciated that the fuel rail 13*c*, fuel injectors 13*d*, and pressure transducer 13*e* are located underhood or in an engine compartment (not shown) of the vehicle as represented by the dotted line and the other components of the fuel system 13 are located underbody of the vehicle. It should also be appreciated that the fuel system 13 provides power conservation, variable pressure, improved pressure and filter diagnostic, pump noise easier to control outside of the fuel tank 12, minimize heating of the fuel tank 12, and remote or integral pressure sensing.

Figure 2:
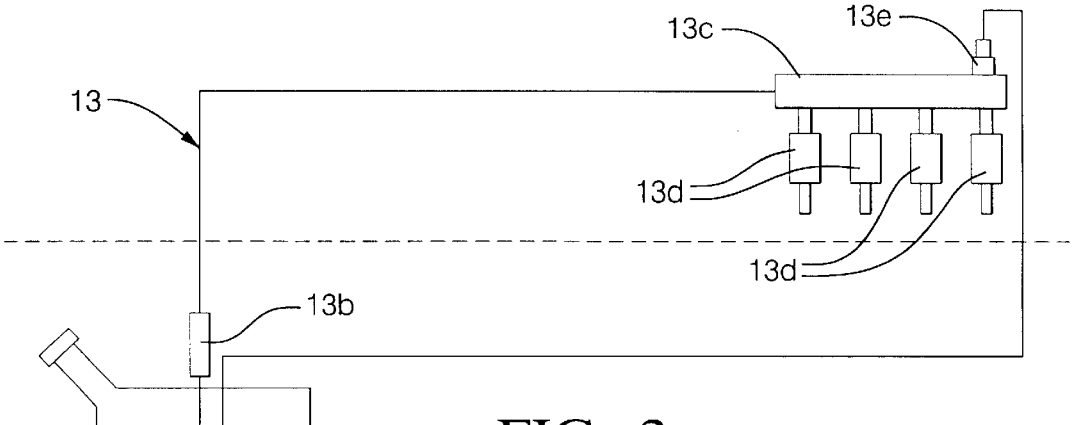
FIG. 2 is a diagrammatic view of the multistage internal gear fuel pump, according to the present invention, illustrated in operational relationship disposed within a fuel tank in a direct injection fuel system.

As illustrated in FIG. 2, the multi-stage internal gear fuel pump 10 used in a direct injection fuel system, generally indicated at 13, with closed loop electronic speed/pressure control. In the fuel system 13, the multi-stage internal gear fuel pump 10 is disposed in the fuel tank 12 and connected to a fuel strainer 13*a* therein and a fuel filter 13*b* mounted outside the fuel tank 12. The fuel system 13 includes a fuel rail 13*c* connected to the fuel filter 13*b* and a plurality of fuel injectors 13*d* connected to the fuel rail 13*c*. As illustrated, the multi-stage internal gear fuel pump 10 may have closed-loop electronic pressure control via a pressure transducer 13*e* mounted to the fuel rail 13*c* or integral with the fuel pump 10 and controlled by an electronic controller (not shown) for pump speed-pressure feedback control. It should be appreciated that the fuel rail 13*c*, fuel injectors 13*d*, and pressure transducer 13*e* are located underhood or in an engine compartment (not shown) of the vehicle as represented by the dotted line and the other components of the fuel system 13 are located underbody of the vehicle.

Figure 3:
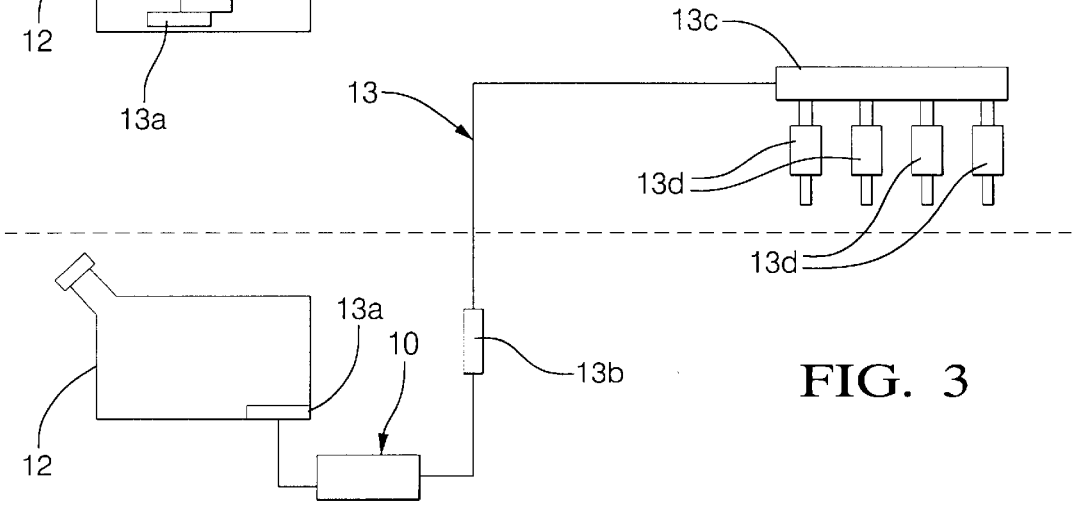
FIG. 3 is a diagrammatic view of the multistage internal gear fuel pump, according to the present invention, illustrated in operational relationship in-line with a fuel tank in a direct injection fuel system.

As illustrated in FIG. 3, the multi-stage internal gear fuel pump 10 is a medium-pressure pump that can be located in the vehicle such as "in-line" close to the fuel tank 12 and connected to a fuel strainer 13*a* therein and a fuel filter 13*b* mounted outside the fuel tank 12. The fuel system 13 includes a fuel rail 13*c* connected to the fuel filter 13*b* and a plurality of fuel injectors 13*d* connected to the fuel rail 13*c*. The multistage internal gear fuel pump 10 has an integral mechanical pressure regulator. The multi-stage internal gear fuel pump 10 may be used in a supply and delivery system (not shown) for direct injection or for methanol/water delivery to a fuel cell reformer (not shown). The multi-stage internal gear fuel pump 10 may also be used for pumping volatile or non-volatile fluids (fuel or water) at a medium (3 Mpa.) or higher discharge pressure injected into cylinders (not shown) of a spark-ignition internal combustion engine (not shown) or fuel cell reformer.

Figure 4:
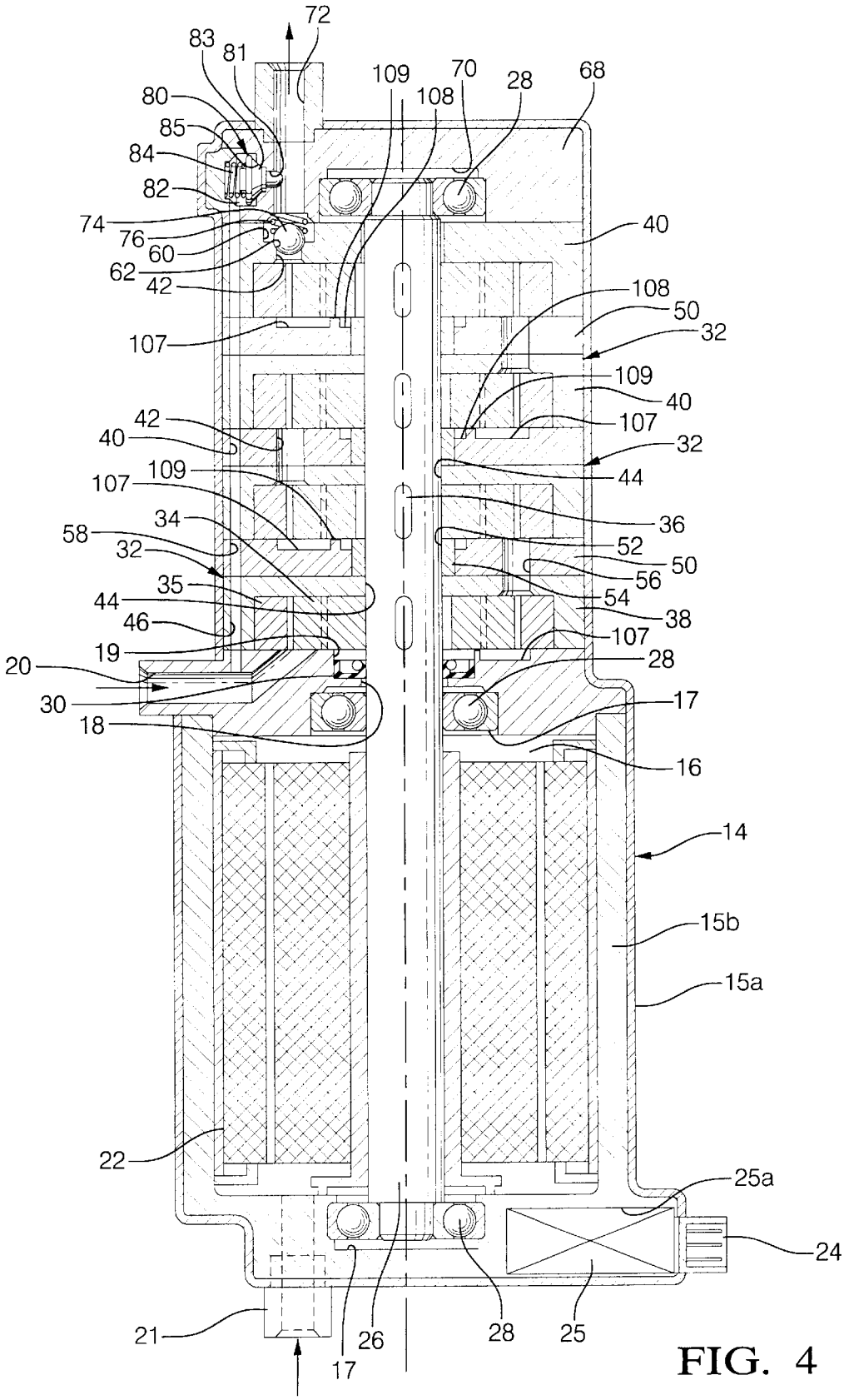
FIG. 4 is a fragmentary elevational view of the multi-stage internal gear fuel pump of FIGS. 1 through 3.
Figure 5:
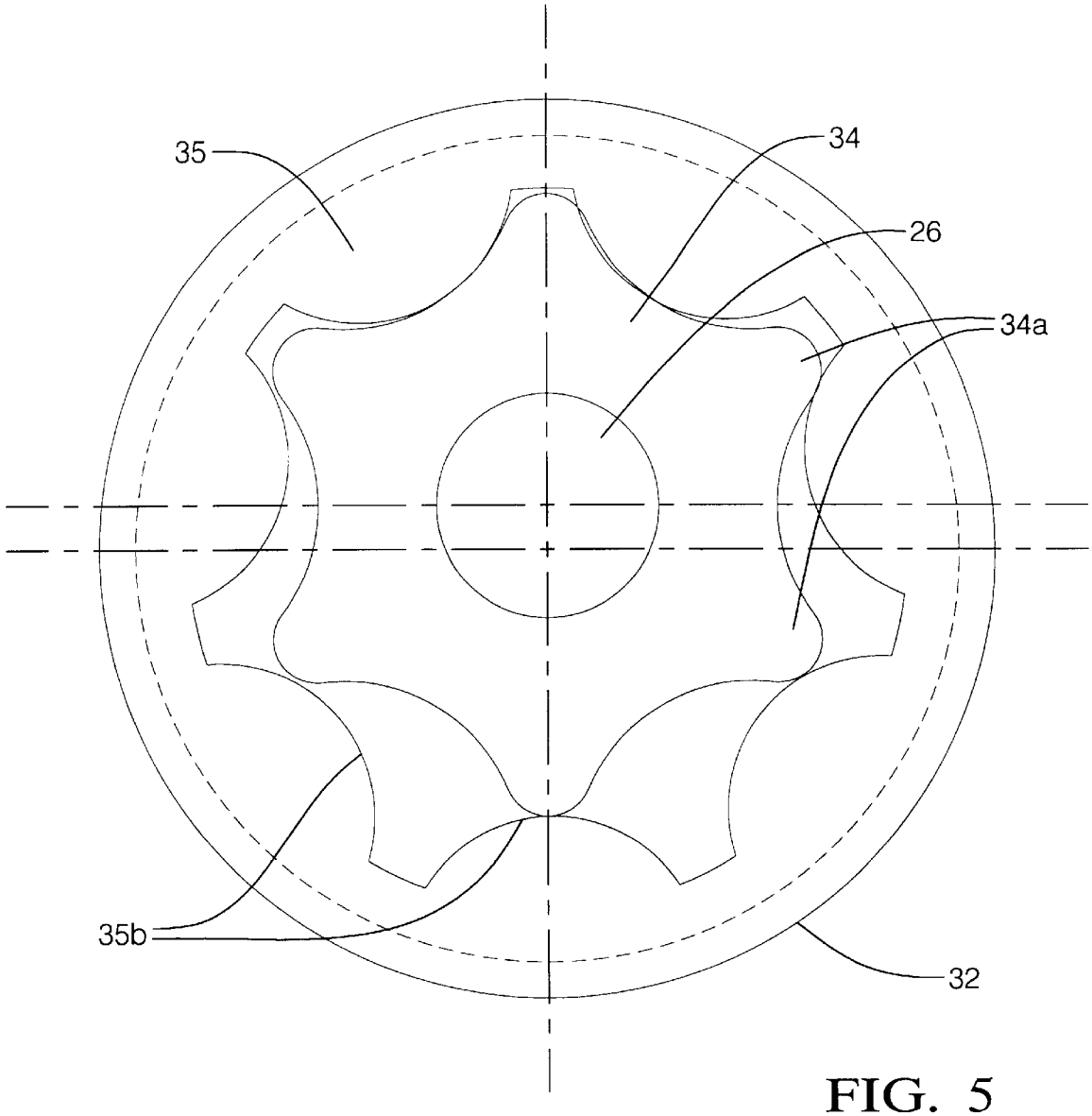
FIG. 5 is a plan view of a pumping module of the multi-stage internal gear fuel pump of FIGS. 1 and 2.

Referring to FIGS. 4 and 5, the multi-stage internal gear fuel pump 10 includes a housing, generally indicated at 14. The housing 14 includes a common outer housing 15*a* and a motor housing 15*b* disposed within the outer housing 15*a* at one axial end. The outer housing 15*a* and motor housing 15*b* extend axially and has a generally circular cross-sectional shape. The motor housing 15*b* has a cavity 16 and a recess 17 at each axial end of the cavity 16. The motor housing 15*b* includes a passageway 18 extending axially through one end and communicating with the cavity 17. The motor housing 15*b* also includes a second recess 19 in the axial end thereof and communicating with the passageway 18. The housing 14 further includes a fluid inlet 20 extending radially into a side of the outer housing 15*a* and axially to an axial end of the motor housing 15*b*. Alternatively, the housing 14 may include a fluid inlet 21 extending axially into an axial end of the outer housing 15*a* and motor housing 15*a* thereof for "in line" pump constructions. The housing 14 is made of a rigid material such as metal.

The multi-stage internal gear fuel pump 10 also includes a motor 22 disposed in the cavity 16. The motor 22 is a canned direct current (DC) type for connection to a source of power such as an electronic controller (not shown) via a connector 24 connected to the housing 14. The multi-stage internal gear fuel pump 10 includes an electronic speed control device 25 located in a compartment 25*a* of the motor housing 15*b* for connection to the electronic controller via the connector 24. It should be appreciated that the canned electrical motor 22 provides a driving mechanism contained in the housing 14, eliminating any leak source and improving volumetric efficiency of the fuel pump 10. It should also be appreciated that the motor 22 and electronic speed control device 25 are conventional and known in the art.

The multi-stage internal gear fuel pump 10 also includes a rotatable shaft 26 disposed within the housing 14 and extending through the passageway 18 of the motor housing 15*b* and motor 22. The multi-stage internal gear fuel pump 10 includes bearings 28 disposed in the recesses 17 for rotatably supporting or journaling the shaft 26. The multi-stage internal gear fuel pump 10 also includes a lip seal 30 disposed in the recess 19 to prevent fluid such as fuel from entering the cavity 16 in radial fluid inlet, pump construction. It should be appreciated that the bearings 28 and lip seal 30 are conventional and known in the art. It should also be appreciated that the shaft 26 extends axially outward from the motor housing 15*b*. It should further be appreciated that the shaft 26 is rotated by the motor 22 and rotates relative to the motor housing 15*b*.

The multi-stage internal gear fuel pump 10 also includes at least one, preferably a plurality of pumping modules, generally indicated at 32, disposed within the outer housing 15*a* and extending axially from the motor housing 15*b* and along the shaft 26 to pump fluid such as fuel. In the embodiment illustrated, the multi-stage internal gear fuel pump 10 includes four pumping modules 32. Each pumping module 32 includes an internal gear 34 and an external gear 35 mounted by suitable means such as a key 36 to the shaft 26 for rotation therewith. As illustrated in FIG. 5, the internal gear 34 and external gear 35 are generally planar and circular in shape. The internal gear 34 has a plurality of external teeth 34*a* disposed circumferentially thereabout and the external gear 35 has a plurality of internal teeth 35*b* disposed circumferentially thereabout and meshing with the teeth 34*a* of the internal gear 34. It should be appreciated that fluid flows axially between the teeth 34*a* and 35*b* of the gears 34 and 35. It should also be appreciated that the output fluid discharge pressure depends on the number of stages or modules 32. It should also be appreciated that the output fluid flow/pressure is related to the size of the internal gear 34 and the external gear 35 and the number of stages built into the fuel pump 10. It should further be appreciated that the multi-stages or pumping modules 32 makes possible a higher discharge pressure than an independent single pumping head.

Each pumping module 32 also includes a pump stage housing 38 disposed over the shaft 26 and internal gear 34. The pump stage housing 38 has a cavity 40 to receive the internal gear 34 and the external gear 35 at one axial end and a module outlet port 42 at the other axial end communicating with the cavity 40. The pump stage housing 38 has a first or shaft passageway 44 extending axially therethrough to allow the shaft 26 to pass. The pump stage housing 38 also has a second or bleed passageway 46 spaced radially from the first passageway 44 and extending axially therethrough for a function to be described.

Each pumping module 32 further includes an inlet plate 50 disposed over the shaft 26 and axially adjacent the pump stage housing 38 to cover and seal the cavity 40. The inlet plate 50 has a first or shaft passageway 52 extending axially therethrough to receive the shaft 26. The inlet plate 50 has a shaft bushing 54 disposed about the shaft 26 and in the first passageway 52. The inlet plate 50 also has a pump module inlet port 66 spaced radially from the first passageway 52 and extending axially therethrough to communicate with the outlet port 42 of the pump stage housing 38. The inlet plate 50 also includes a second or bleed passageway 58 spaced radially from the first passageway 52 and extending axially therethrough and communicating with the second passageway 46 of the pump stage housing 38 for a function to be described.

The last pumping module 32 has an axial recess 60 disposed in the outlet port 42 and includes a seat 62 for an outlet check valve 74 to be described, that restricts backflow from the pressurized fuel system 13 into the fuel pump 10.

The multi-stage internal gear fuel pump 10 also includes a pump outlet cover 68 disposed axially adjacent to the last pumping module 32. The outlet cover 68 extends axially and has a generally circular cross-sectional shape. The outlet cover 68 has a cavity 70 at one axial end. The outlet cover 68 also includes a fluid outlet 72 extending axially therethrough. The outlet cover 68 also includes a bearing 28 disposed in the cavity 70 for rotatably supporting or journaling the end of the shaft 26. It should be appreciated that the outer housing 15*a* encases the outlet cover 68, inlet plates 50, pump stage housings 38 and motor housing 15*b* together assuring the necessary compression that no leakage exists between pump stages and covers.

The multi-stage internal gear fuel pump 10 includes an outlet check valve 74 to maintain system pressure/relief. The check valve 74 is a spherically shaped member disposed in the recess 60 and cooperating with the seat 62. The multi-stage internal gear fuel pump 10 also includes a spring 76 to urge the check valve 74 against the seat 62.

The multi-stage internal gear fuel pump 10 further includes a pressure regulator, generally indicated at 80, disposed radially from and connected to the fluid outlet 72 via a regulator return passageway 81. The pressure regulator 80 has an outlet or bleed passageway 82 spaced radially from the fluid outlet 72 and communicating with the second passageway 46 and the regulator return passageway 81. The pressure regulator 80 has a valve member 83 disposed between the passageways 81 and 82 and a spring 84 and contacting the valve member 83 to urge the valve member 83 against a seat 85 to close the passageway 81. It should be appreciated that the pressure regulator 80 is calibrated for a specific discharge pressure, required by the fuel system 13.

The multi-stage internal gear fuel pump 10 may include at least one shadow port 107 on the inlet plate 50 to balance pressure on faces of the internal gear 34 and the external gear 35. The inlet plate 50 may include a blind counter-bore 108 with a feed in groove 109 to facilitate and establish a lubricating fluid film under the internal gear 34 and external gear 35.

In operation of the multi-stage internal gear fuel pump 10, the motor 22 rotates the shaft 26, which in turn, rotates the internal gears 34 and the external gears 35. Fluid enters either the inlet 20 or inlet 21 as indicated by the arrow and flows through spaces between the teeth 34*a* and 35*b* of the internal gears 34 and the external gears 35 and the second passageways 46 and 68 of the pump stage housings 38 and inlet plates 60. The fluid flows through the ports 42 and 56 past the check valve 74 to the outlet 72 in the outlet cover 68.

Figure 6:
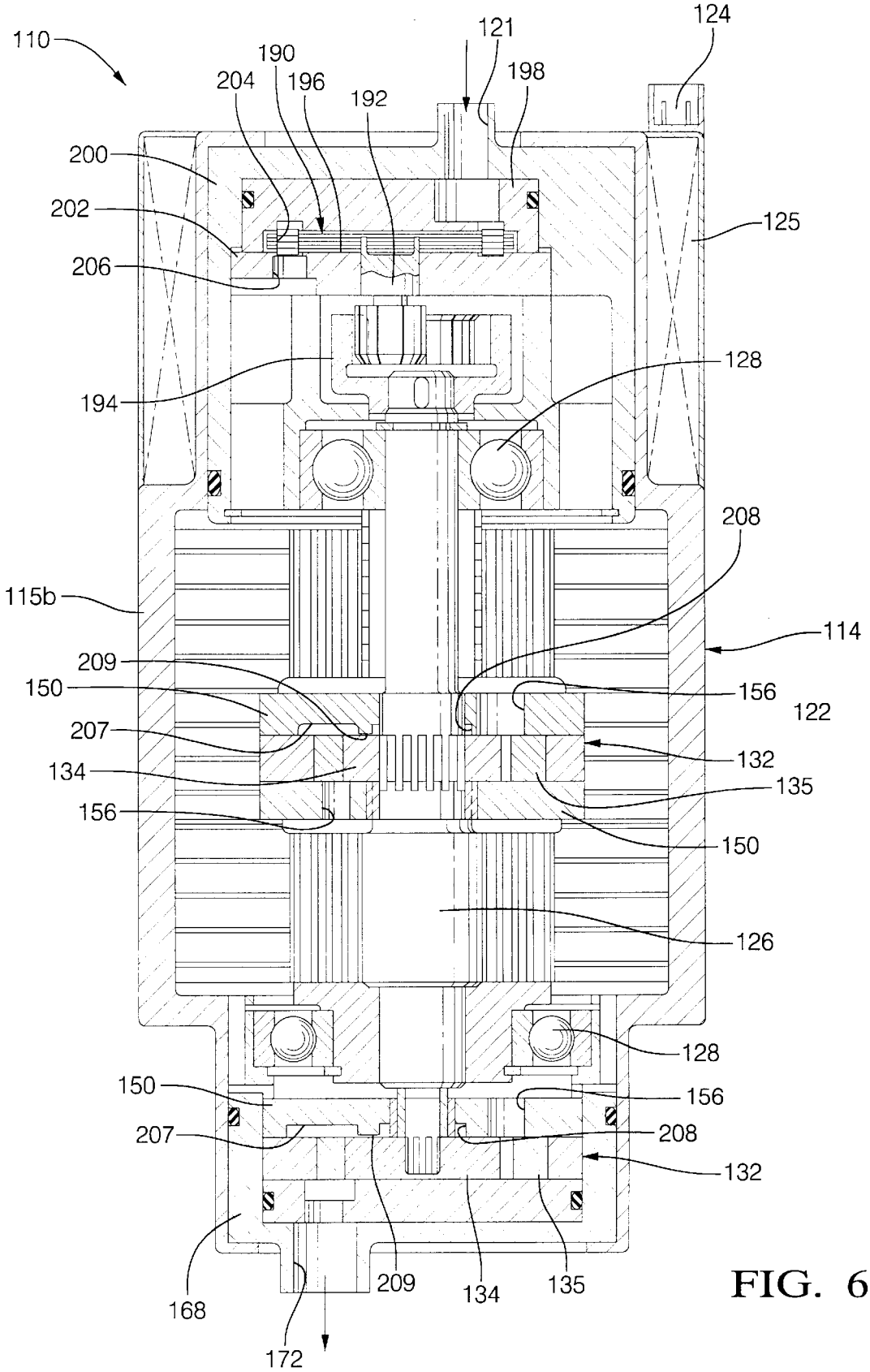
FIG. 6 is a fragmentary elevational view of another embodiment, according to the present invention, of the multi-stage internal gear fuel pump of FIGS. 1 through 3.

Referring to FIG. 6, another embodiment, according to the present invention, of the multi-stage internal gear fuel pump 10 is shown. Like parts have like numbers increased by one hundred (100). In this embodiment, the multi-stage internal gear fuel pump 110 has a turbine pumping module 190 includes a turbine driver 192 operatively connected to the shaft 126 via a gearset 194. The turbine pumping module 190 also includes a turbine impeller 196 disposed about the turbine driver 192. The turbine impeller 196 is mounted by suitable means to the turbine driver 192 for rotation therewith. The turbine pumping module 190 includes a turbine ring 198 disposed about the turbine impeller 196. The turbine ring 198 is solidly mounted between an inlet cover 200 and a turbine outlet plate 202 that is pressed into a cylindrical cavity of the housing 114 to create a separation between a turbine compartment and a motor/gerotor compartment. The turbine driver 192, turbine impeller 196, and turbine ring 198 are generally circular in shape. The turbine impeller 196 has a plurality of special shaped blades disposed about the circumference. The turbine impeller 196 has a plurality of apertures 204 extending axially therethrough to allow fluid flow through to a special shaped outlet port 206 in the turbine outlet plate 202. It should be appreciated that the turbine driver 192 and turbine impeller 196 rotate with the shaft 126.

The multi-stage internal gear fuel pump 110 may include at least one shadow port 207 on the inlet plate 150 to balance pressure on faces of the internal gear 134 and the external gear 135. The inlet plate 150 may include a blind counterbore 208 with a feed in groove 209 to facilitate and establish a lubricating fluid film under the internal gear 134 and external gear 135.

In operation of the multi-stage internal gear fuel pump 110, the motor 122 rotates the shaft 126, which in turn, rotates the turbine driver 192 and the turbine impeller 196 and also rotates the internal gear 134 and the external gear 135. Fluid enters the inlet 121 as indicated by the arrow and flows through the apertures 204 of the turbine impeller 196 that increase the fluid pressure to a level that vapor creation and cavitations are prevented, and feeds through the motor 122 and inlet plate 150 and passageway 156 to the first stage (set) of the pumping modules 132. The fluid flows through the pumping modules 132 that create high-pressure flow to the outlet 172 in the outlet cover 168.

Figure 7:
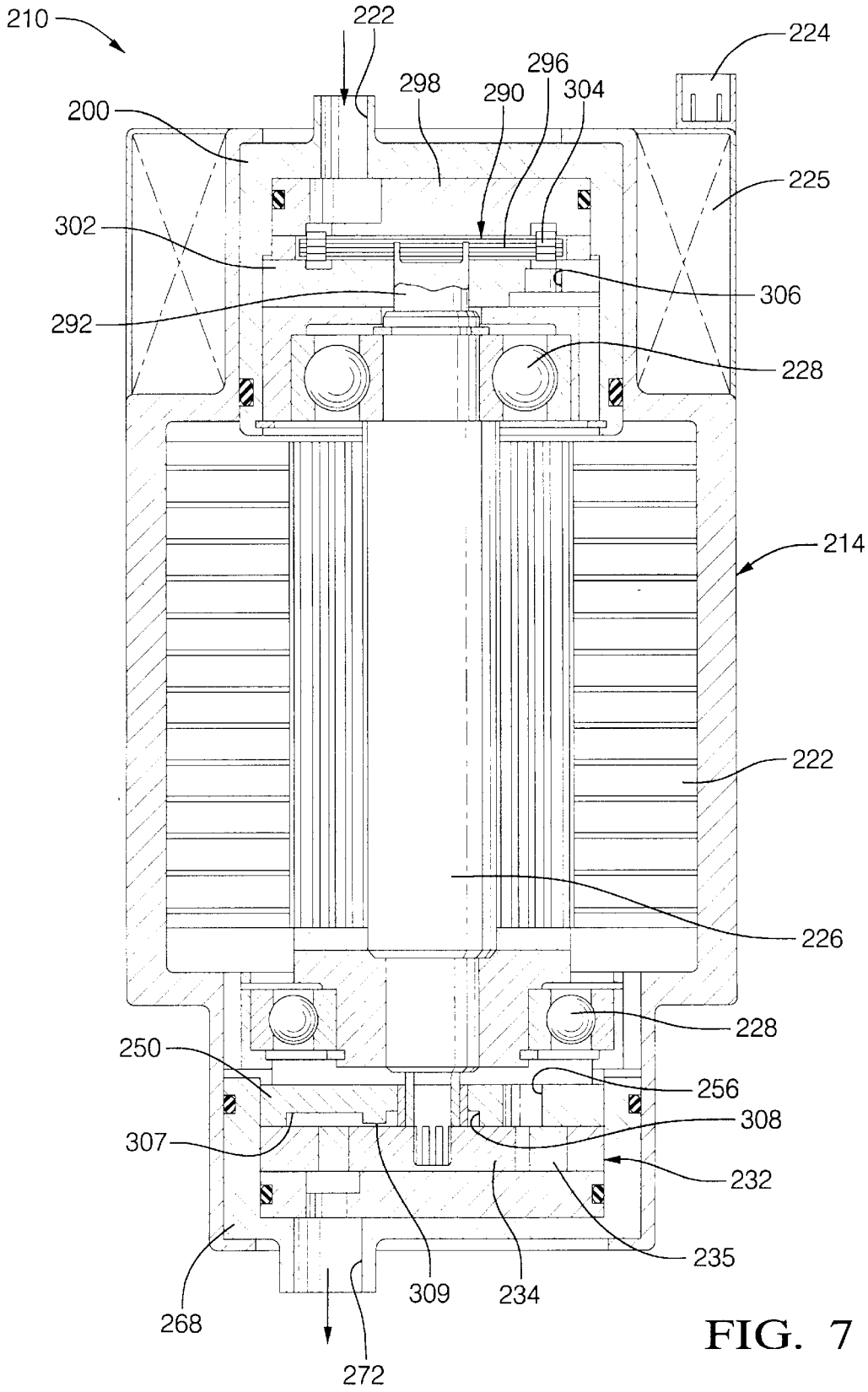
FIG. 7 is a fragmentary elevational view of yet another embodiment, according to the present invention, of the multi-stage internal gear fuel pump of FIGS. 1 through 3.

Referring to FIG. 7, yet another embodiment, according to the present invention, of the multi-stage internal gear fuel pump 10 is shown. Like parts have like numbers increased by two hundred (200). In this embodiment, the multi-stage internal gear fuel pump 210 has a turbine pumping module 290 includes a turbine driver 292 solidly connected to the shaft 226. The turbine pumping module 290 also includes a turbine impeller 296 disposed about the turbine driver 292. The turbine impeller 296 is mounted by suitable means to the turbine driver 292 for rotation therewith. The turbine pumping module 290 includes a turbine ring 298 disposed about the turbine impeller 296. The turbine ring 298 is solidly mounted between an inlet cover 300 and a turbine outlet plate 302 that is pressed into a cylindrical cavity of the housing 214 to create a separation between a turbine compartment and a motor/gerotor compartment. The turbine driver 292, turbine impeller 296, and turbine ring 298 are generally circular in shape. The turbine impeller 296 has a plurality of special shaped blades disposed about the circumference. The turbine impeller 296 has a plurality of apertures 304 extending axially therethrough to allow fluid flow through to a special shaped outlet port 306 in the turbine outlet plate 302. It should be appreciated that the turbine driver 292 and turbine impeller 296 rotate with the shaft 226.

The multi-stage internal gear fuel pump 210 may include at least one shadow port 307 on the inlet plate 250 to balance pressure on faces of the internal gear 234 and the external gear 235. The inlet plate 250 may include a blind counterbore 308 with a feed in groove 309 to facilitate and establish a lubricating fluid film under the internal gear 234 and external gear 235.

In operation of the multi-stage internal gear fuel pump 210, the motor 222 rotates the shaft 226, which in turn, rotates the turbine driver 292 and the turbine impeller 296 and also rotates the internal gear 234 and the external gear 235. Fluid enters the inlet 221 as indicated by the arrow and flows through the apertures 304 of the turbine impeller 296 that increase the fluid pressure to a level that vapor creation and cavitations are prevented, and feeds through the motor 222 and inlet plate 250 and passageway 256 to the first stage (set) of the pumping modules 232. The fluid flows through the pumping modules 232 that create high-pressure flow to the outlet 272 in the outlet cover 268.

Figure 8:
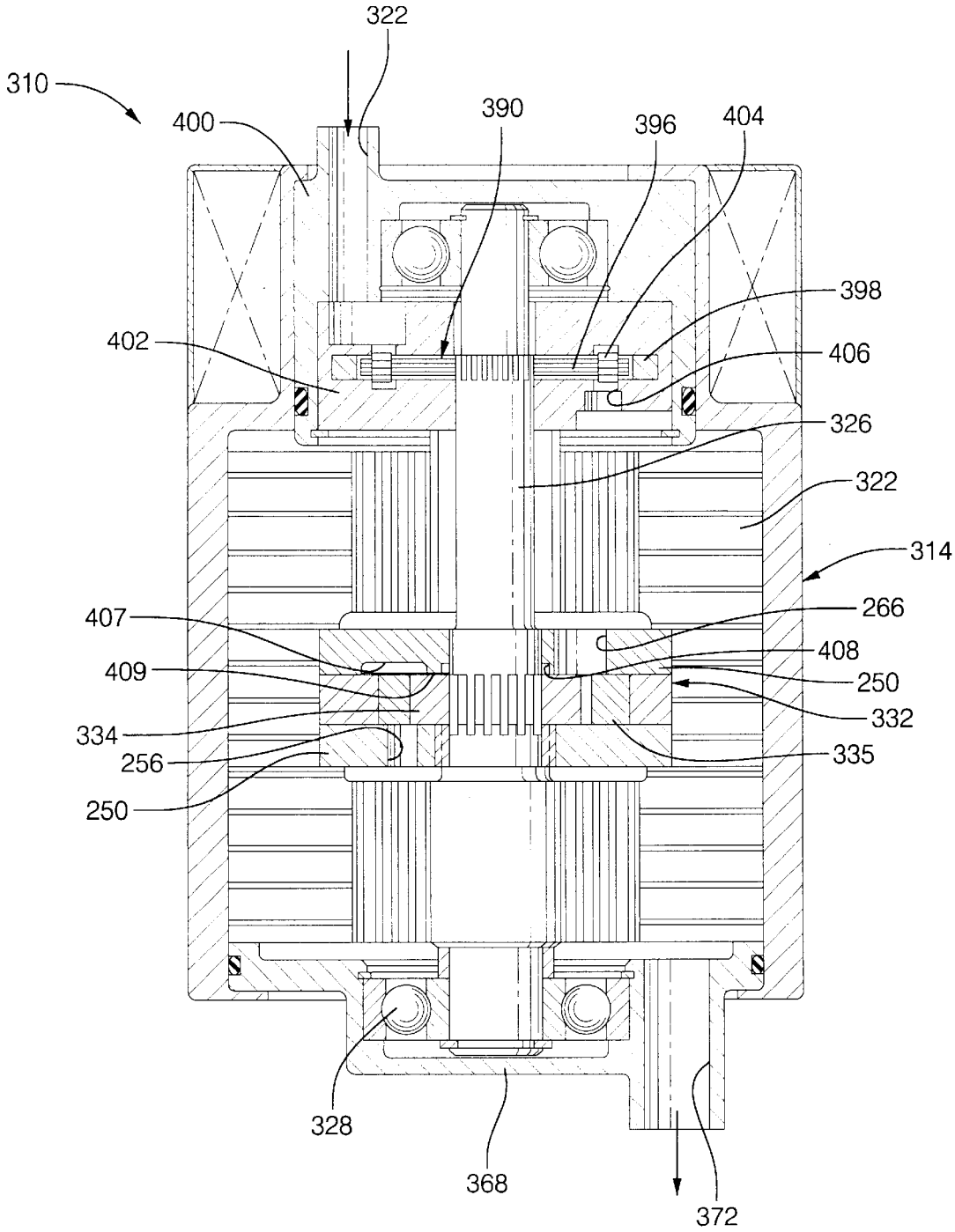
FIG. 8 is a fragmentary elevational view of still another embodiment, according to the present invention, of the multi-stage internal gear fuel pump of FIGS. 1 through 3.

Referring to FIG. 8, still another embodiment, according to the present invention, of the multi-stage internal gear fuel pump 10 is shown. Like parts have like numbers increased by three hundred (300). In this embodiment, the multi-stage internal gear fuel pump 310 has a turbine pumping module 390 includes a turbine impeller 396 solidly connected to the shaft 326. The turbine impeller 396 is mounted by suitable means to the shaft 326 for rotation therewith. The turbine pumping module 390 includes a turbine ring 398 disposed about the turbine impeller 396. The turbine ring 398 is solidly mounted to a turbine outlet plate 402 that is pressed into a cylindrical cavity of the housing 314 to create a separation between a turbine compartment and a motor/gerotor compartment. The turbine impeller 396 and turbine ring 398 are generally planar and circular in shape. The turbine impeller 396 has a plurality of special shaped blades disposed about the circumference. The turbine impeller 396 has a plurality of apertures 404 extending axially therethrough to allow fluid flow through to a special shaped outlet port 406 in the turbine outlet plate 402. It should be appreciated that the turbine impeller 396 rotates with the shaft 326.

The multi-stage internal gear fuel pump 310 may include at least one shadow port 407 on the inlet plate 350 to balance pressure on faces of the internal gear 334 and the external gear 335. The inlet plate 350 may include a blind counterbore 408 with a feed in groove 409 to facilitate and establish a lubricating fluid film under the internal gear 334 and external gear 335.

In operation of the multi-stage internal gear fuel pump 310, the motor 322 rotates the shaft 326, which in turn, rotates the turbine impeller 396 and also rotates the internal gear 334 and the external gear 335. Fluid enters the inlet 321 as indicated by the arrow and flows through the apertures 404 of the turbine impeller 396 that increase the fluid pressure to a level that vapor creation and cavitations are prevented, and feeds through the motor 322 and inlet plate 350 and passageway 356 to the first stage (set) of the pumping modules 332. The fluid flows through the pumping modules 332 that create high-pressure flow to the outlet 372 in the outlet cover 368.

Figure 9:
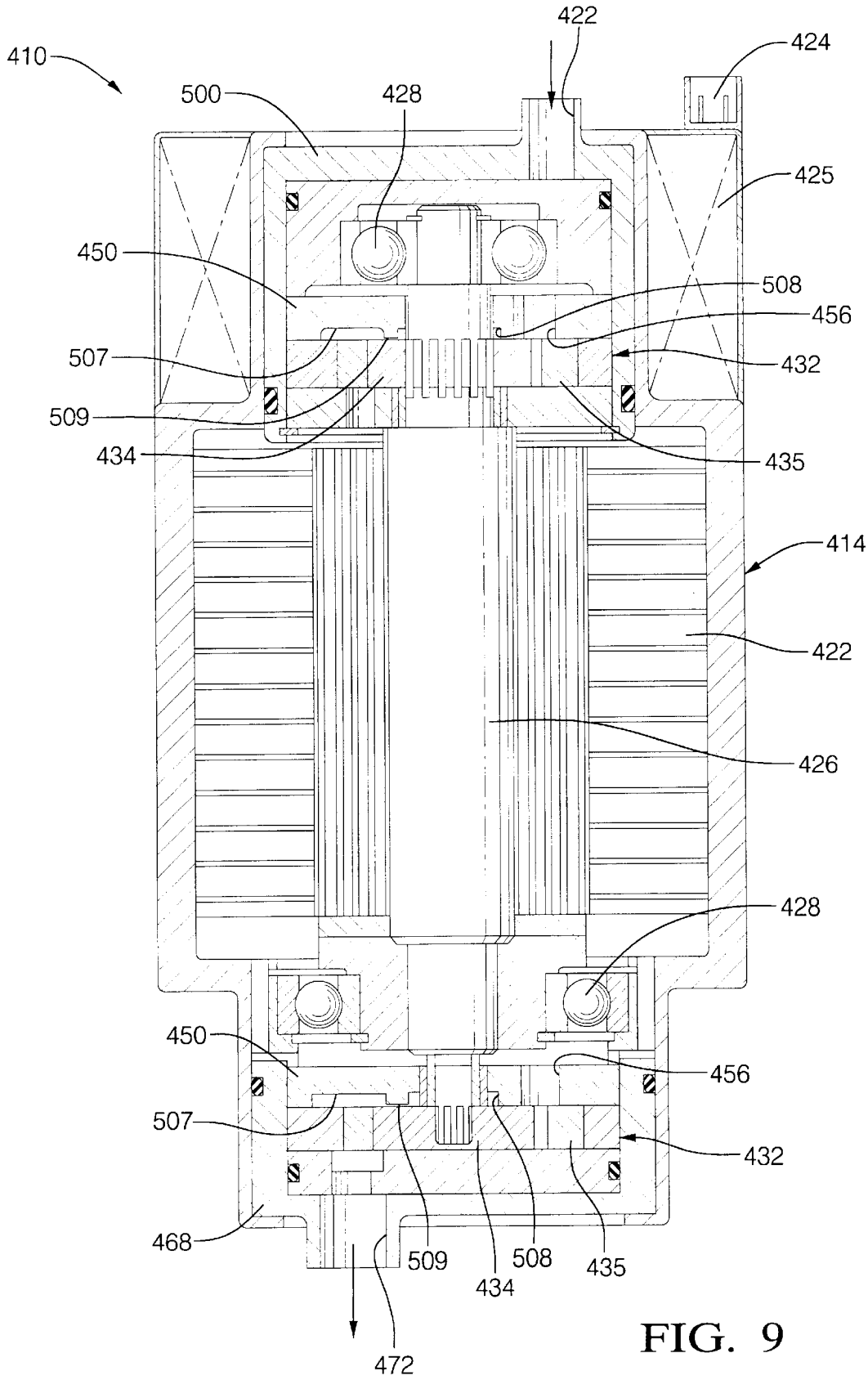
FIG. 9 is a fragmentary elevational view of a further embodiment, according to the present invention, of the multi-stage internal gear fuel pump of FIGS. 1 through 3.

Referring to FIG. 9, a further another embodiment, according to the present invention, of the multi-stage internal gear fuel pump 10 is shown. Like parts have like numbers increased by four hundred (400). In this embodiment, the multi-stage internal gear fuel pump 410 has one pumping module 432 disposed between the inlet 422 and the motor 422 and another pumping module 432 disposed between the motor 422 and the outlet 472.

The multi-stage internal gear fuel pump 410 may include at least one shadow port 507 on the inlet plate 450 to balance pressure on faces of the internal gear 434 and the external gear 435. The inlet plate 450 may include a blind counterbore 508 with a feed in groove 509 to facilitate and establish a lubricating fluid film under the internal gear 434 and external gear 435.

In operation of the multi-stage internal gear fuel pump 410, the motor 422 rotates the shaft 426, which in turn, rotates the internal gear 434 and the external gear 435 of the pumping modules 432. Fluid enters the inlet 421 as indicated by the arrow and flows through the passageway 456 to the first stage (set) of the pumping modules 432, and feeds through the motor 422 and passageway 456 to the last stage (set) of the pumping modules 432 and to the outlet 472 in the outlet cover 468.

Accordingly, the multi-stage internal gear fuel pump 10 is sized to fit in-line or in a fuel tank of the vehicle, is modular and small size, compact construction. The multi-stage internal gear fuel pump 10 has a high working speed at start-up, works between −40° C. and 150° C., and is pulseless due to pumping nature of gear pumps. The multi-stage internal gear fuel pump 10 meets fuel emissions by totally containing the fuel in a sealed circuit, eliminating need for controlling the fuel emissions due to leak and pressure control by the fuel pressure regulator 80 incorporated into the outlet cover 68. The multi-stage internal gear fuel pump 10 is maintenance free (sealed) and has high durability. The multi-stage internal gear fuel pump 10 has a simple construction for automated assembly, incorporates standard materials, simplifies the driving system, eliminating expensive dynamic seals, and creates a high pressure fluid state by connecting multiple pumping stages.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A multi-stage internal gear fuel pump comprising:

a housing having an inlet and an outlet;

a motor disposed in said housing;

a shaft extending axially and disposed in said housing for rotation by said motor;

a plurality of pumping modules disposed axially along said shaft and each having an internal gear and an external gear cooperating with each other for rotation by said motor to pump fuel from said inlet to said outlet; and at least one of said pumping modules having an inlet plate disposed over said shaft and axially between said motor and said internal gear and said external gear.

2. A multi-stage internal gear fuel pump as set forth in claim 1 wherein said external gear includes a plurality of internal teeth disposed circumferentially thereabout.

3. A multi-stage internal gear fuel pump as set forth in claim 2 wherein said internal gear includes a plurality of external teeth disposed circumferentially thereabout, said external teeth meshing with said internal teeth.

4. A multi-stage internal gear fuel pump as set forth in claim 1 wherein each of said pumping modules includes a pump module housing disposed over said shaft and having a cavity to receive said internal gear and said external gear.

5. A multi-stage internal gear fuel pump as set forth in claim 4 wherein said inlet plate is disposed adjacent said pump module housing to cover and seal said cavity.

6. A multi-stage internal gear fuel pump as set forth in claim 5 wherein said pump module housing and said inlet plate each have a shaft passageway extending axially therethrough to receive said shaft.

7. A multi-stage internal gear fuel pump as set forth in claim 5 wherein said pump module housing has an outlet port extending axially and communicating with said cavity and said inlet plate has an inlet port extending axially and communicating with said outlet port.

8. A multi-stage internal gear fuel pump as set forth in claim 1 including an outlet cover disposed axially adjacent a last one of said pumping modules and forming said outlet.

9. A multi-stage internal gear fuel pump as set forth in claim 1 including at least one shadow port on said inlet plate to balance pressure on faces of said internal gear and said external gear.

10. A multi-stage internal gear fuel pump comprising:

a housing having an inlet and an outlet;

a motor disposed in said housing;

a shaft extending axially and disposed in said housing for rotation by said motor;

a plurality of pumping modules disposed axially along said shaft and each having an internal gear and an external gear cooperating with each other for rotation by said motor to pump fuel from said inlet to said outlet;

a pump module housing disposed over said shaft and having a cavity to receive said internal gear and said external gear;

an inlet plate disposed adjacent said pump module housing to cover and seal said cavity; and wherein said pump module housing and said inlet plate each have a bleed passageway extending axially therethrough.

11. A multi-stage internal gear fuel pump comprising:

a housing having an inlet and an outlet;

a motor disposed in said housing;

a shaft extending axially and disposed in said housing for rotation by said motor;

a plurality of pumping modules disposed axially along said shaft and each having an internal gear and an external gear cooperating with each other for rotation by said motor to pump fuel from said inlet to said outlet;

an outlet cover disposed axially adjacent a last one of said pumping modules and forming said outlet; and wherein said outlet cover includes a pressure regulator disposed therein to regulate pressure of the fluid to be discharged through said outlet.

12. A multi-stage internal gear fuel pump as set forth in claim 11 wherein said outlet cover includes a bleed passageway extending axially therethrough and a return passageway communicating with said bleed passageway and said outlet.

13. A multi-stage internal gear fuel pump as set forth in claim 12 wherein said pressure regulator comprises a valve member disposed between said bleed passageway and said return passageway and a spring contacting said valve member to urge said valve member to close said return passageway.

14. A multi-stage internal gear fuel pump comprising:

a housing having an inlet and an outlet;

a motor disposed in said housing;

a shaft extending axially and disposed in said housing for rotation by said motor;

at least one pumping module disposed axially along said shaft and having an internal gear and an external gear cooperating with each other for rotation by said motor to pump fuel from said inlet to said outlet;

a turbine pumping module operatively connected to said shaft; and said at least one pumping module having an inlet plate disposed over said shaft and axially between said motor and said internal gear and said external gear such that a fluid entering said inlet first passes through said inlet plate before reaching said internal gear and said external gear.

15. A multi-stage internal gear fuel pump as set forth in claim 14 wherein said turbine pumping module comprises a turbine driver connected to said shaft and a turbine impeller disposed about said turbine driver.

16. A multi-stage internal gear fuel pump as set forth in claim 15 wherein said turbine pumping module includes a turbine ring disposed about said turbine impeller and operatively connected to said housing.

17. A multi-stage internal gear fuel pump as set forth in claim 16 wherein said turbine pumping module includes a turbine outlet plate disposed axially between said turbine driver and said turbine impeller and connected to said housing.

18. A multi-stage internal gear fuel pump comprising:

a housing having an inlet and an outlet;

a motor disposed in said housing;

a shaft extending axially and disposed in said housing for rotation by said motor;

at least one pumping module disposed axially along said shaft and having an internal gear and an external gear cooperating with each other for rotation by said motor to pump fuel from said inlet to said outlet;

a pump module housing disposed over said shaft and having a cavity to receive said internal gear and said external gear;

an inlet plate disposed adjacent said pump module housing to cover and seal said cavity; and wherein said inlet plate has a blind counter-bore with a feed in groove to facilitate and establish a lubricating fluid film under said internal and external gears.

19. A multi-stage internal gear fuel pump for a vehicle comprising:

a housing having an inlet and an outlet;

a motor disposed in said housing;

a shaft extending axially and disposed in said housing for rotation by said motor;

a plurality of pumping modules disposed axially along said shaft and each having an internal gear and an external gear cooperating with each other for rotation by said motor to pump fuel from said inlet to said outlet; and an outlet cover including a pressure regulator disposed therein to regulate pressure of the fluid to be discharged through said outlet.

20. A multi-stage internal gear fuel pump as set forth in claim 19 wherein each of said pumping modules includes a pump module housing disposed over said shaft and having a cavity to receive said internal gear and said external gear.

21. A multi-stage internal gear fuel pump as set forth in claim 20 wherein each of said pumping modules includes an inlet plate disposed adjacent said pump module housing to cover and seal said cavity.

22. A multi-stage internal gear fuel pump as set forth in claim 21 wherein said pump module housing and said inlet plate each have a shaft passageway extending axially therethrough to receive said shaft.

23. A multi-stage internal gear fuel pump as set forth in claim 21 wherein said pump module housing and said inlet plate each have a bleed passageway extending axially therethrough.

24. A multi-stage internal gear fuel pump as set forth in claim 21 wherein said pump module housing has an outlet port extending axially and communicating with said cavity and said inlet plate has an inlet port extending axially and communicating with said outlet port.

25. A multi-stage internal gear fuel pump as set forth in claim 24 wherein said outlet cover includes a bleed passageway extending axially therethrough and a return passageway communicating with said bleed passageway and said outlet.

26. A multi-stage internal gear fuel pump as set forth in claim 25 wherein said pressure regulator comprises a valve member disposed between said bleed passageway and said return passageway and a spring contacting said valve member to urge said valve member to close said return passageway.

27. A multi-stage internal gear fuel pump as set forth in claim 24 wherein said pump module housing has a recess in said outlet and a valve seat disposed in said recess.

28. A multi-stage internal gear fuel pump as set forth in claim 27 including a check valve disposed in said recess.

29. A multi-stage internal gear fuel pump as set forth in claim 28 including a spring disposed in said recess to urge said check valve against said seat.

30. A multi-stage internal gear fuel pump for a vehicle comprising:

a housing having an inlet to allow fuel to enter;

a motor disposed in said housing;

a shaft extending axially and disposed in said housing for rotation by said motor; and a plurality of pumping modules disposed axially along said shaft and each having an internal gear and an external gear cooperating with each other for rotation by said motor to pump fuel from said inlet;

an outlet cover disposed axially adjacent a last one of said pumping modules and forming an outlet to allow fuel to exit; and said outlet cover including a pressure regulator disposed therein to regulate discharge fluid pressure through said outlet.

* * * * *